US005999065A

United States Patent [19]

Furutani et al.

[11] Patent Number: 5,999,065

[45] **Date of Patent: *Dec. 7, 1999**

[54] COMPOSITE HIGH-FREQUENCY COMPONENT

[75] Inventors: Koji Furutani, Shiga-ken; Norio Nakajima, Takatsuki; Ken Tonegawa, Kyoto; Mitsuhide Kato; Koji Tanaka, both of Shiga-ken; Tatsuya Ueda, Kyoto, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/783,480

[22] Filed: Jan. 14, 1997

Related U.S. Application Data

[63] Continuation-in-part of application No. 08/518,667, Aug. 24, 1995, Pat. No. 5,783,976.

[30] Foreign Application Priority Data

Jan. 16, 1996 [JP] Japan ..... 8-04864

[51] Int. Cl.[6] ..... H01P 1/15; H01P 5/12

[52] U.S. Cl. ..... 333/103; 333/134; 333/204

[58] Field of Search ..... 333/167, 202, 333/204, 126, 134, 103, 104; 455/78, 80, 83

[56] References Cited

U.S. PATENT DOCUMENTS

| | | | |
|---|---|---|---|
| 5,513,382 | 4/1996 | Agahi-Kesheh et al. | 333/104 X |
| 5,525,942 | 6/1996 | Horii et al. | 333/134 |
| 5,594,394 | 1/1997 | Sasaki et al. | 333/202 X |
| 5,783,976 | 7/1998 | Furutani et al. | 333/204 X |

FOREIGN PATENT DOCUMENTS

| | | | |
|---|---|---|---|
| 468801 | 1/1992 | European Pat. Off. . | |
| 4-103209 | 4/1992 | Japan | 333/134 |
| 6-197042 | 7/1994 | Japan . | |
| 6-197043 | 7/1994 | Japan . | |
| 7-74672 | 3/1995 | Japan . | |
| 2289574 | 11/1995 | United Kingdom . | |

OTHER PUBLICATIONS

H. Mandai, et al., "Advanced Multi–Layer Ceramic Surface–Mount Functional Components", *45th Electronic Components and Technology Conference*, May 21–24, 1995, Las Vegas, US, pp. 247–250.

Y. Taguchi, et al., "Microwave Characteristics of Alumina–Glass Composite Multi–Layer Substrates with Co–fired Copper Conductors", *IEICE Transactions of Electronics*, Jun., 1993, vol. E76–C, No. 6, Tokyo, Japan.

*Primary Examiner*—Seungsook Ham

*Attorney, Agent, or Firm*—Ostrolenk, Faber, Gerb & Soffen, LLP

[57] ABSTRACT

A composite high-frequency component is designed to occupy a smaller area and a smaller volume when mounted in an apparatus, can be located in the apparatus with improved flexibility, and is able to operate without an impedance matching circuit. The composite high-frequency component includes a multilayer substrate, diodes constituting a high-frequency switch component, and a circuit base. External terminals for connection to a transmitting circuit, a receiving circuit and an antenna, external terminals for control and an external terminal for connection to ground potential are formed on an outer surface of the multilayer substrate. Strip lines and capacitors constituting the high-frequency switch and strip lines and capacitors constituting a low-pass filter circuit are formed in the multilayer substrate.

11 Claims, 6 Drawing Sheets

COMPOSITE HIGH-FREQUENCY COMPONENT

This application is a continuation-in-part of Ser. No. 08/518,667 filed Aug. 24, 1995, now U.S. Pat. No. 5,783, 976; and is related to Ser. No. 09/070,319 filed Apr. 30, 1998, which is a divisional of Ser. No. 08/518,667.

BACKGROUND OF THE INVENTION

1. Field of the Invention

The present invention relates generally to composite high-frequency components and, more particularly, to a composite high-frequency component formed by connecting a high-frequency component such as a high-frequency switch component and a filter component.

2. Description of the Related Art

Referring to FIG. 10, a high-frequency switch component is used to selectively establish a connection between a transmitting circuit TX and an antenna ANT and a connection between a receiving circuit RX and the antenna ANT.

Referring to FIG. 11, a high-frequency switch component 1 is connected to an antenna ANT, to a transmitting circuit TX and to a receiving circuit RX. The anode of a diode D1 is connected to the transmitting circuit TX through a capacitor C1. The anode of the diode D1 is also connected to ground potential through a series circuit of a distributed constant line L1 and a capacitor C2. If the wavelength of a transmitted signal from the transmitting circuit TX is λ, the line length of the distributed constant line L1 is set to λ/4 or less. A control terminal Vc1 is connected to a point of connection between the distributed constant line L1 and the capacitor C2. A control circuit for switching the high-frequency switch component 1 is connected to the control terminal Vc1. The cathode of the diode D1 is connected to the antenna ANT through a capacitor C3. A series circuit of a distributed constant line L2 and a capacitor C4 is connected in parallel with the diode D1 (between the anode and the cathode).

To the capacitor C3 connected to the antenna ANT, the receiving circuit RX is connected through a series circuit of a distributed constant line L3 and a capacitor C5. The line length of the distributed constant line L3 is also set to λ/4 or less, as in the case of the distributed constant line L1. The anode of a diode D2 is connected to a point of connection between the distributed constant line L2 and the capacitor C5. The cathode of the diode D2 is connected to ground potential through a capacitor C6. A control terminal Vc2 is connected to a point of connection between the diode D2 and the capacitor C6. The control circuit for switching the high-frequency switch component 1 is connected to the control terminal Vc2 as well as to the terminal Vc1.

To perform transmitting by using the thus-arranged high-frequency switch component 1, a positive bias voltage is applied to the control terminal Vc1 while a negative bias voltage is applied to the control terminal Vc2. These voltages act as forward bias voltages on the diodes D1 and D2 to turn on diodes D1 and D2. At this time, DC components are blocked by the capacitors C1 to C6 and the voltages supplied to the control voltages Vc1 and Vc2 are applied only to the circuits which include the diodes D1 and D2. Accordingly, the distributed constant line L3 is grounded by the diode D2 and resonates at a transmitting frequency, so that the impedance thereof becomes substantially infinitely large. Therefore, substantially no transmitted signal from the transmitting circuit TX is transmitted to the receiving circuit RX. The transmitted signal is transmitted to the antenna ANT via the capacitor C1, the diode D1 and the capacitor C3. Since the distributed constant circuit L1 is grounded through the capacitor C2, it resonates at the transmitting frequency, so that the impedance thereof becomes substantially infinitely large. The transmitted signal is thereby prevented from leaking to ground.

On the other hand, at the time of receiving, a negative bias voltage is applied to the control terminal Vc1 while a positive bias voltage is applied to the control terminal Vc2. These voltages act as reverse bias voltages on the diodes D1 and D2 to turn off diodes D1 and D2, so that a received signal from the antenna ANT is transmitted to the receiving circuit RX via the capacitor C3, the distributed constant line L3 and the capacitor C5, and is not substantially transmitted to the transmitting circuit TX.

As described above, the high-frequency switch component 1 can switch transmitted and received signals by controlling the bias voltages applied to the control terminals Vc1 and Vc2.

The series circuit of the distributed constant line L2 and the capacitor C4 is used to reduce the insertion loss and reflection loss by increasing the impedance at the point of connection between the diode D1 and the distributed constant line L2 when the diode D1 is off by forming a parallel resonant circuit. It resonates by the combined electrostatic capacitance of the diode D1 in the off state and the capacitor C4 and the inductance component of the distributed constant line L2, at the frequency of the received signal.

Conventionally, a composite high-frequency component is made by connecting a filter component to the above-described high-frequency switch component. However, the high-frequency component and the filter component are designed and manufactured separately from each other. Therefore, the area and the volume occupied by these components on a circuit board are large, so that the flexibility of the circuit arrangement is reduced.

It is also necessary to newly add an impedance matching circuit to the high-frequency component and the filter component for the purpose of impedance matching between the high-frequency component and the filter component.

Further, additional design time is required for designing the impedance matching circuit.

SUMMARY OF THE INVENTION

In view of the above-described problems of the conventional art, an object of the present invention is to provide a composite high-frequency component which occupies a smaller area and a smaller volume when mounted in an apparatus, which can be arranged with improved flexibility, and which requires no impedance matching circuit.

To achieve the above-described object, according to the present invention, there is provided a composite high-frequency component comprising a high-frequency component formed of a plurality of circuit elements, and a filter component formed of a multilayer substrate which is a lamination of a plurality of dielectric layers on at least one of which at least one internal electrodes or distributed constant line is formed. At least one of the circuit elements of the high-frequency component is mounted on a circuit base while the other circuit elements of the high-frequency component are incorporated in or supported on the multilayer substrate.

In the above-described composite high-frequency component, the high-frequency component may be a high-frequency switch component.

In the above-described composite high-frequency component, the filter component may be a low-pass filter component or a band-pass filter component.

In the composite high-frequency component of the present invention, at least one of the circuit elements constituting the high-frequency component is incorporated in the multilayer substrate forming the filter component, thereby achieving a reduction in overall size.

Also, the circuit of the high-frequency component and the circuit of the filter component can be designed simultaneously in a composite form. Therefore, an improved design effect can be achieved with respect to impedance matching between the circuit of the high-frequency component and the circuit of the filter component.

DESCRIPTION OF EMBODIMENTS OF THE INVENTION

Figure 1:
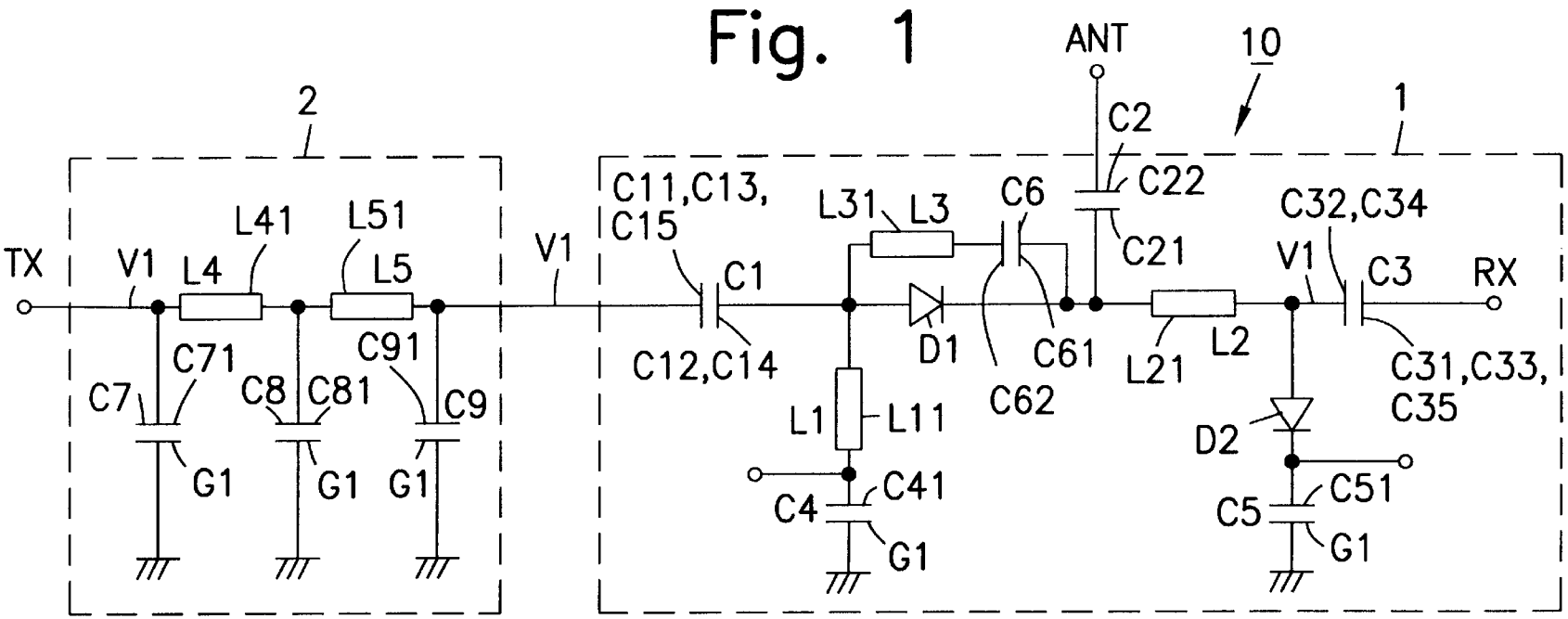
FIG. 1 is a circuit diagram of an embodiment of a composite high-frequency component in accordance with the present invention.

An embodiment of the present invention will be described below with reference to the accompanying drawings. Portions of the embodiment of the invention identical or corresponding to those of the conventional arrangement are indicated by the same reference characters and the description for them will not be repeated.

FIG. 1 shows a circuit diagram of an embodiment of a composite high-frequency component 10 in accordance with the present invention.

The composite high-frequency component 10 has a high-frequency switch component 1 and a filter component, e.g., a Butterworth low-pass filter component 2 connected between a transmitting circuit TX and one end of capacitor C1 of the high-frequency switch component 1. The low-pass filter component 2 is formed of distributed constant lines L4 and L5 and capacitors C7, C8, and C9. The connection relationship between the elements in the low-pass filter component 2 is well-known and, therefore, will not be explained.

Figure 2:
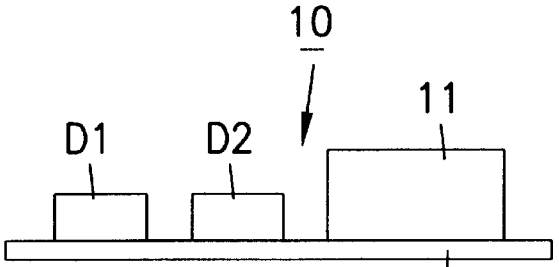
FIG. 2 is a side view of the composite high-frequency component shown in FIG. 1.
Figure 3:
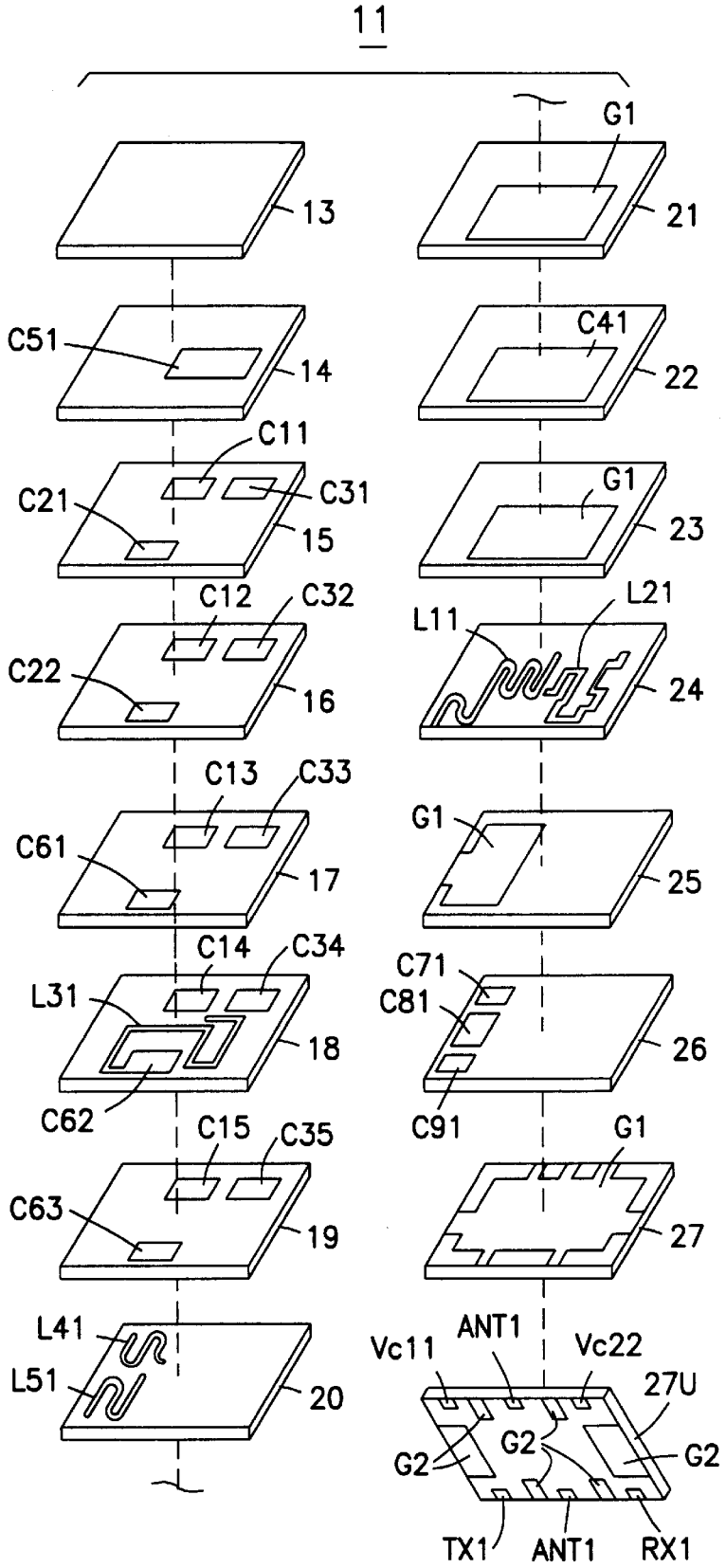
FIG. 3 is an exploded perspective view of a multilayer substrate constituting the composite high-frequency component shown in FIG. 1, wherein the first two characters of each three-character reference in FIG. 3 correspond to a respective two-character reference in FIG. 1.

FIG. 2 shows a side view of the composite high-frequency component 10. The composite high-frequency component 10 is formed by mounting high-frequency devices, e.g., diodes D1 and D2 constituting the high-frequency switch 1 on a circuit base 12 together with a multilayer substrate 11. As shown in FIG. 3, the multilayer substrate 11 is formed by superposing first to fifteenth dielectric layers 13 to 27 one on another. Capacitors C1 to C6 constituting the high-frequency switch 1, distributed constant lines L1 to L3 and the low-pass filter component 2 are incorporated in the multilayer substrate 11.

No component is mounted on the first dielectric layer 13. An internal electrode, i.e., a capacitor electrode C51, is formed on the second dielectric layer 14. Also, capacitor electrodes C11, C21, and C31 are formed on the third dielectric layer 15; capacitor electrodes C12, C22, and C32 on the fourth dielectric layer 16; capacitor electrodes C13, C23, and C61 on the fifth dielectric layer 17; and capacitor electrodes C15, C35, and C63 on the seventh dielectric layer 19. A capacitor electrode C41 is formed on the tenth dielectric layer 22, and capacitor electrodes C71, C81, and C91 are formed on the fourteenth dielectric layer 26.

Further, capacitor electrodes C14, C34, and C62 and a distributed constant line, i.e., a strip line L31, are formed on the sixth dielectric layer 18, strip lines L41 and L51 are formed on the eighth dielectric layer 20, and strip lines L11 and L21 are formed on the twelfth dielectric layer 24.

An internal ground electrode G1 is formed on each of the ninth, eleventh, thirteenth and fifteenth dielectric layers 21, 23, 25, and 27.

On a lower surface (indicated by 27*u* in FIG. 3) of the fifteenth dielectric layer 27 are formed an external electrode TX1 for connection to the transmitting circuit TX, an external electrode RX1 for connection to a receiving circuit RX, an external electrode ANT1 for connection to an antenna ANT, external electrodes Vc11 and Vc22 for control, and an external electrode G2 for connection to ground potential.

Signal lines (not shown) and via holes (not shown) are formed at desired positions on the first to fifteenth dielectric layers 13 to 27, and external electrodes (not shown) are formed on outer surfaces of the multilayer substrate and on the circuit base 12. Capacitors C1 to C6 constituting the high-frequency switch 1, the multilayer substrate 11 incorporating distributed constant lines L1 to L3 and low-pass filter component 2, and diodes D1 and D2 are mounted on the circuit base 2, and the multilayer substrate 11 and the diodes D1 and D2 are connected as desired, thus forming the composite high-frequency component 10 equivalent to the circuit configuration shown in FIG. 1.

The multilayer substrate constituting the above-described composite high-frequency component is manufactured as described below. First, dielectric ceramic green sheets are prepared. A metallic paste is applied on the dielectric ceramic green sheets in accordance with the shapes of the internal electrodes, the distributed constant lines and the signal lines. Next, the dielectric ceramic green sheets on which the metallic paste is printed in the predetermined shapes are stacked and baked to form a multilayer substrate as a lamination of the dielectric layers.

The metallic paste is printed on the outer surface of the multilayer substrate and is baked to form the external electrodes. The multilayer substrate may be formed in such a manner that, after lamination of the dielectric ceramic green sheets, the metallic paste is printed in the shapes corresponding to the external electrodes and is fired together with the dielectric layers.

In the above-described embodiment of the present invention, the capacitors and the distributed constant lines constituting the high-frequency component and the filter component are incorporated in one multilayer substrate formed by laminating a plurality of dielectric layers, thereby achieving a reduction in overall size. As a result, the area and volume occupied on the circuit base can be reduced.

The circuit of the high-frequency component and the circuit of the filter component can be designed simultaneously in a composite form. Therefore, an improved design effect can be achieved with respect to impedance matching between the circuit of the high-frequency component and the circuit of the filter component. Thus, the need for adding an impedance matching circuit is eliminated and the entire circuit can be simplified.

Also, the need for the time for designing an impedance matching circuit can be eliminated.

There are various high-frequency switch circuits other than that described above. For example, any of high-frequency switch circuits such as those described in Japanese Patent Laid-Open Publication Nos. 6-197042, 6-197043 and 7-74672 may be used.

In the above-described embodiment of the present invention, diodes are used as high-frequency devices. However, bipolar transistors, field effect transistors and the like may be used instead of diodes.

The present invention has been described with respect to an embodiment using strip lines as distributed constant lines. However, microstrip lines, coplanar lines and the like may be used in place of the strip lines.

The present invention has been described with respect to an embodiment incorporating capacitors and strip lines in the multilayer substrate. However, resistor components such as printed resistors may also be incorporated in the multilayer substrate.

Also, the present invention has been described with respect to the diodes being directly mounted on the circuit base. However, capacitors or resistor components such as chip resistors may also be mounted directly on the circuit base.

In the above-described connection relationship between the high-frequency component and the filter component, low-pass filter component 2 is connected between transmitting circuit TX and high-frequency switch component 1. However, the present invention is also advantageous in the case of connecting a low-pass filter 2 between high-frequency switch component 1 and receiving circuit RX and/or between high-frequency switch component 1 and antenna ANT, as in the above-described embodiment.

Figure 4:
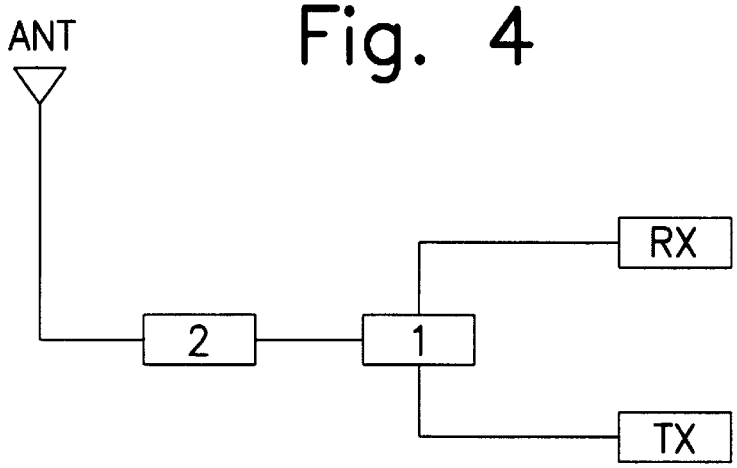
FIG. 4 is a schematic circuit diagram of a first modification of the composite high-frequency component of the present invention.
Figure 5:
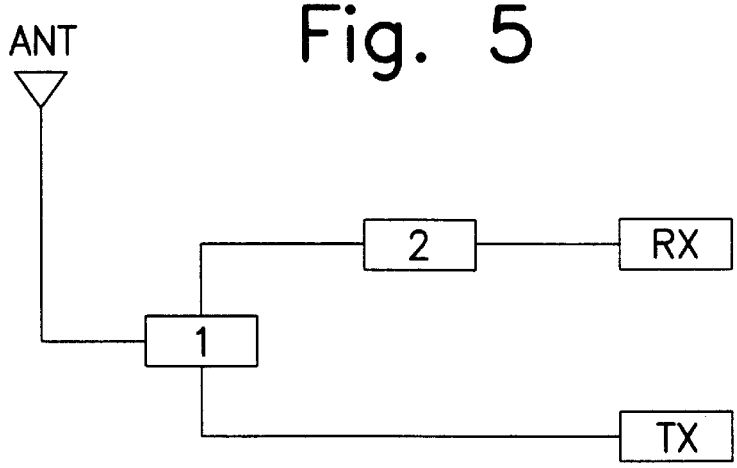
FIG. 5 is a schematic circuit diagram of a second modification of the composite high-frequency component of the present invention.
Figure 6:
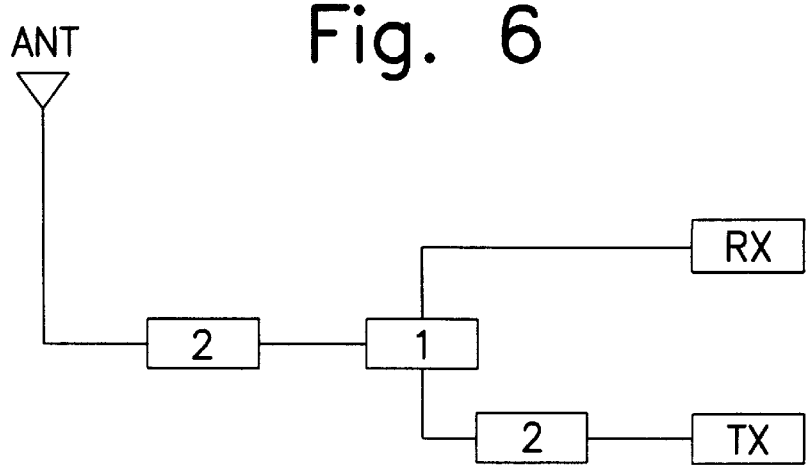
FIG. 6 is a schematic circuit diagram of a third modification of the composite high-frequency component of the present invention.
Figure 7:
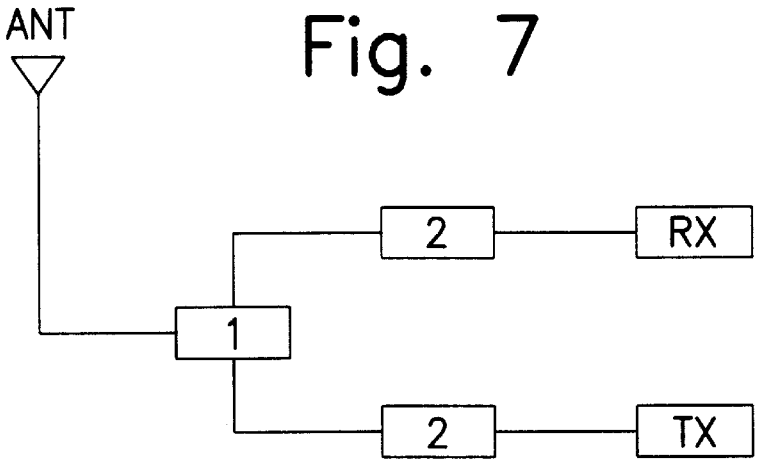
FIG. 7 is a schematic circuit diagram of a fourth modification of the composite high-frequency component of the present invention.
Figure 8:
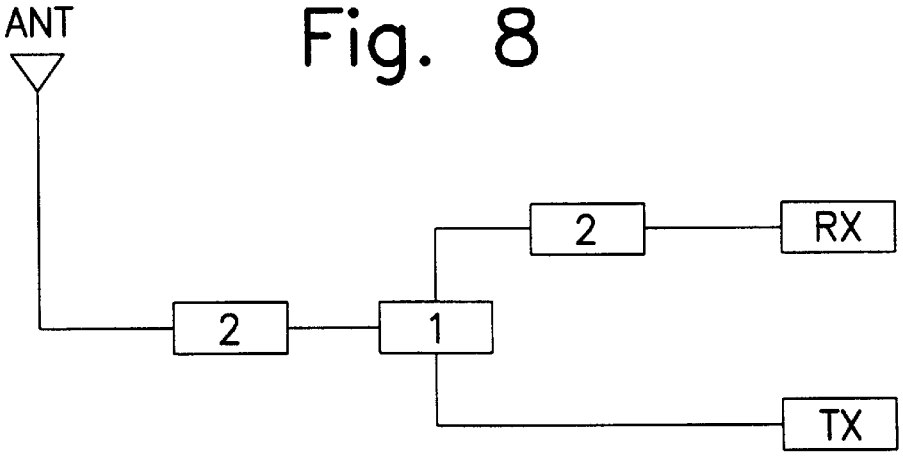
FIG. 8 is a schematic circuit diagram of a fifth modification of the composite high-frequency component of the present invention.
Figure 9:
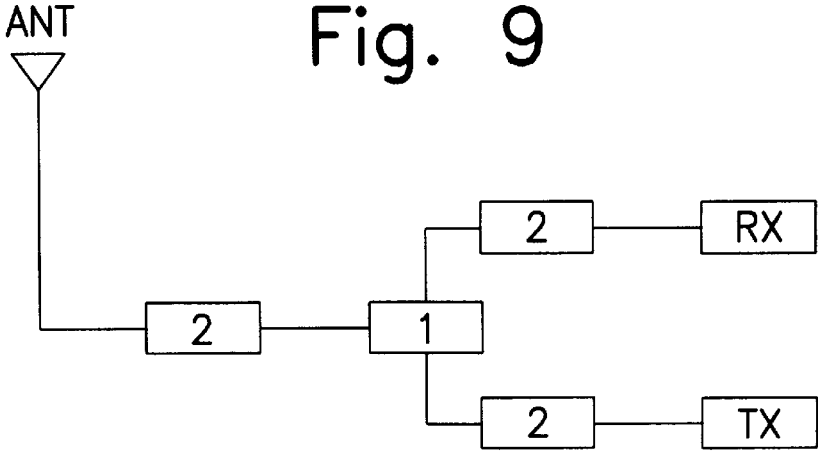
FIG. 9 is a schematic circuit diagram of a sixth modification of the composite high-frequency component of the present invention.
Figure 10:
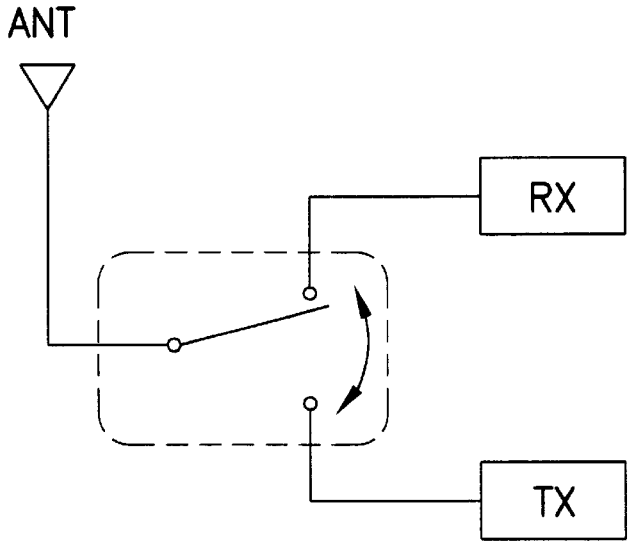
Fig. 10 PRIOR ART
FIG. 10 is a schematic block diagram of a conventional high-frequency component.
Figure 11:
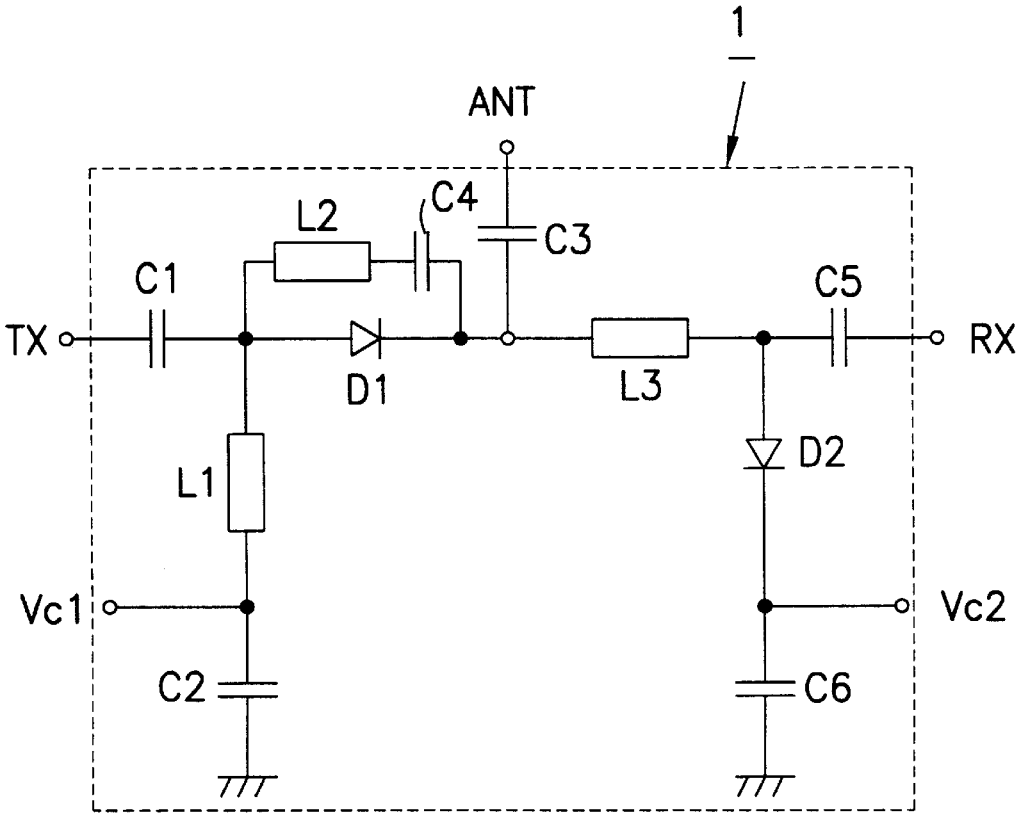
Fig. 11 PRIOR ART
FIG. 11 is a circuit diagram of the conventional high-frequency component.

For example, the following cases are possible: the case of connecting low-pass filter component 2 between antenna ANT and high-frequency switch component 1, as shown in FIG. 4; the case of connecting low-pass filter component 2 between receiving circuit RX and high-frequency switch component 1, as shown in FIG. 5; the case of respectively connecting low-pass filter components 2 between transmitting circuit TX and high-frequency switch component 1 and between antenna ANT and high-frequency switch component 1, as shown in FIG. 6; the case of respectively connecting low-pass filter components 2 between transmitting circuit TX and high-frequency switch component 1 and between receiving circuit RX and high-frequency switch component 1, as shown in FIG. 7; the case of respectively connecting low-pass filter components 2 between receiving circuit RX and high-frequency switch component 1 and between antenna ANT and high-frequency switch component 1, as shown in FIG. 8; and the case of respectively connecting low-pass filter components 2 between transmitting circuit TX and high-frequency switch component 1, between receiving circuit RX and high-frequency switch component 1 and between antenna ANT and high-frequency switch component 1, as shown in FIG. 9.

Figure 12:
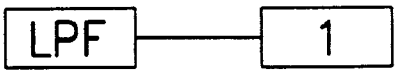
FIG. 12 schematically shows a low-pass filter LPF connected to a high-frequency switch component 1.
Figure 13:
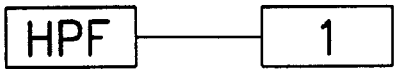
FIG. 13 is similar to FIG. 12, but shows instead a high-pass filter (HPF)
Figure 14:
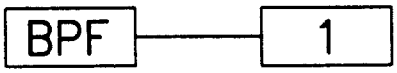
FIG. 14 is similar to FIG. 12, but shows instead a band-pass (BPF)
Figure 15:
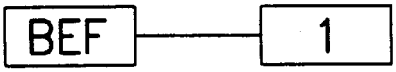
FIG. 15 is similar to FIG. 15, but shows instead a band-elimination filter (BEF).

Also, the present invention has been described with respect to the case of using a low-pass filter component as the filter component connected to the high-frequency component. See FIG. 12 which schematically shows a low-pass filter LPF connected to the high-frequency switch component 1. Alternatively, a high-pass filter component HPF (FIG. 13), a band-pass filter component BPF (FIG. 14) or a band elimination filter component BEF (FIG. 15) may be used in combination with the high-frequency component.

In the composite high-frequency component of the present invention, at least one of the circuit elements constituting the high-frequency component is mounted on the circuit base together with the multilayer substrate, and the other circuit elements of the high-frequency component and the filter component are incorporated in or supported on the multilayer substrate, thereby achieving a reduction in overall size. Accordingly, the area and volume occupied in an apparatus in which the components are mounted can be reduced.

Also, the circuit of the high-frequency component and the circuit of the filter component can be designed simultaneously in a composite form. Therefore, an improved design effect can be achieved with respect to impedance matching between the circuit of the high-frequency component and the circuit of the filter component. Thus, the need for adding an impedance matching circuit is eliminated and the entire circuit can be simplified.

Also, the need for the time for designing an impedance matching circuit can be eliminated.

What is claimed is:

1. A composite high frequency apparatus comprising:

a substrate;

a single ceramic chip including a plurality of laminated ceramic layers and a plurality of electrodes formed on the laminated ceramic layers, wherein:

a first part of the ceramic layers and a first part of the electrodes in said chip constitute a high frequency switch comprising capacitors and a strip lines, said high frequency switch provides first and second signal paths and has first and second input/output terminals corresponding respectively to said first and second signal paths, and a third input/output terminal being common to both of said first and second signal paths, a second part of the ceramic layers and a second part of the electrodes in said chip constitute a high frequency filter comprising capacitors and strip lines, and the high frequency filter is electrically connected to said high frequency switch by one of said electrodes being connected within the chip to one of said first and second input/output terminals of the high frequency switch.

2. A composite high-frequency component according to claim 1, wherein said high frequency filter is a band-pass filter.

3. A composite high-frequency component according to claim 1, wherein said high frequency filter is a low-pass filter.

4. A composite high-frequency component according to claim 1, wherein said high frequency filter is a high-pass filter.

5. A composite high-frequency component according to claim 1, wherein said high frequency filter is a band elimination filter.

6. A composite high-frequency component according to claim 1, wherein said high-frequency switch further comprises and additional circuit element; and said additional circuit element of said high-frequency switch and said single ceramic chip are both mounted on said substrate.

7. A composite high-frequency component according to claim 6, wherein said additional circuit element is a diode.

8. A composite high frequency apparatus comprising:

a substrate;

a single ceramic chip including a plurality of laminated ceramic layers and a plurality of electrodes formed on the laminated ceramic layers, wherein:

a first part of the electrodes on the ceramic layers in said chip constitute a high frequency switch comprising capacitors and strip lines, a second part of the electrodes on the ceramic layers in said chip are separate from said first part of the electrodes and constitute a high frequency filter comprising capacitors and strip lines, and a third part of said electrodes electrically connect the high frequency filter to the high frequency switch within said chip, wherein:

said high frequency switch provides first and second signal paths and has first and second input/output terminals corresponding respectively to said first and second signal paths, and a third input/output terminal being common to both of said first and second signal paths, and the high frequency filter is electrically connected to said high frequency switch by one of said electrodes being connected within the chip to one of said first and second input/output terminals of the high frequency switch.

9. A composite high frequency apparatus comprising:

a substrate;

a single ceramic chip including a plurality of laminated ceramic layers and a plurality of electrodes formed on the laminated ceramic layers, wherein:

a first part of the electrodes on the ceramic layers in said chip constitute a high frequency switch comprising capacitors and strip lines, a second part of the electrodes on the ceramic layers in said chip are separate from said first part of the electrodes and constitute a high frequency filter comprising capacitors and strip lines, and a third part of said electrodes electrically connect the high frequency filter to the high frequency switch within said chip, wherein said high frequency filter is a band-pass filter.

10. A composite high frequency apparatus comprising:

a substrate;

a single ceramic chip including a plurality of laminated ceramic layers and a plurality of electrodes formed on the laminated ceramic layers, wherein:

a first part of the electrodes on the ceramic layers in said chip constitute a high frequency switch comprising capacitors and strip lines, a second part of the electrodes on the ceramic layers in said chip are separate from said first part of the electrodes and constitute a high frequency filter comprising capacitors and strip lines, and a third part of said electrodes electrically connect the high frequency filter to the high frequency switch within said chip, wherein said high-frequency filter is a high-pass filter.

11. A composite high frequency apparatus comprising:

a substrate;

a single ceramic chip including a plurality of laminated ceramic layers and a plurality of electrodes formed on the laminated ceramic layers, wherein:

a first part of the electrodes on the ceramic layers in said chip constitute a high frequency switch comprising capacitors and strip lines, a second part of the electrodes on the ceramic layers in said chip are separate from said first part of the electrodes and constitute a high frequency filter comprising capacitors and strip lines, and a third part of said electrodes electrically connect the high frequency filter to the high frequency switch within said chip, wherein said high-frequency filter is a band elimination filter.

* * * * *